United States Patent [19]

Steele

[11] Patent Number: 4,943,163

[45] Date of Patent: Jul. 24, 1990

[54] BLENDER FOR PNEUMATICALLY MIXING BATCHES OF DRY GRANULAR MATERIALS BY TUMBLING

[75] Inventor: James R. Steele, Stillwater, Minn.

[73] Assignee: Dynamic Air Inc., St. Paul, Minn.

[21] Appl. No.: 411,107

[22] Filed: Sep. 22, 1989

[51] Int. Cl.[5] ..... B01F 13/02

[52] U.S. Cl. ..... 366/106; 366/101; 366/107

[58] Field of Search ..... 366/3, 101, 106, 107, 366/177, 341, 336, 192, 267; 222/1, 195, 630; 406/85, 137; 251/63

[56] References Cited

U.S. PATENT DOCUMENTS

| | | | |
|---|---|---|---|
| 3,003,752 | 10/1961 | Frost | 366/106 |
| 3,216,629 | 11/1965 | Goins | 366/336 |
| 3,583,681 | 6/1971 | Brown | 366/159 |
| 3,648,985 | 3/1972 | Matweecha | 366/107 |
| 3,913,891 | 10/1975 | Steele | 366/192 |
| 4,326,810 | 4/1982 | Schofield et al. | 366/106 |
| 4,398,828 | 8/1983 | Kluger et al. | 366/107 |
| 4,472,062 | 9/1984 | Balzau et al. | 366/107 |
| 4,606,158 | 8/1986 | Krauss | 366/107 |

*Primary Examiner*—Timothy F. Simone
*Attorney, Agent, or Firm*—Jacobson and Johnson

[57] ABSTRACT

A vertically oriented generally cylindrical vessel or hopper holds dry granular materials which are mixed together by applying repeated short bursts of pressurized air from nozzles in an air manifold which direct the air substantially parallel or slightly inward to the longitudinal axis of the hopper to repeatedly lift and drop the materials in the hopper to create a tumbling action. Adjustable throttling valve means are provided in the pressurized input to the manifold to control the air flow to and the pressure at the manifold.

4 Claims, 2 Drawing Sheets

21
10
11
39
19
37
12
36
13
35
20
20
26
15
16
14
25
23
23
22
22

BLENDER FOR PNEUMATICALLY MIXING BATCHES OF DRY GRANULAR MATERIALS BY TUMBLING

FIELD OF THE INVENTION

This invention is generally directed toward pneumatically mixing or blending together a number of dry granular materials contained in a hopper or a bin. More specifically, the invention provides for mixing by a tumbling action.

DESCRIPTION OF THE PRIOR ART

U.S. Pat. No. 3,913,891 dated Oct. 21, 1975 by Steele titled "AIR BLENDER FOR GRANULAR MATERIALS" describes a blender having many of the same components as the instant invention. The '891 patent describes a bin or hopper having an opening at the top for receiving granular materials, vertical cylindrical sidewalls and inward sloping bottom or lower walls directed toward a central discharge outlet opening at the bottom. A manifold containing pressurized air surrounds the outlet opening and the materials are mixed together by repetitively applying short bursts of pressurized air through piston-operated openings or nozzles in the manifold upward into the interior of the hopper. As illustrated and described in the '891 patent, the nozzles or openings direct the air upward and outward from the center toward the walls of the hopper to cause a swirling action to mix the materials together. After the materials are blended together the discharge outlet is opened and the materials are discharged from the hopper. It has been found that with some large grain materials and heavy loads of materials this type of swirling action does not result in adequate blending or mixing of the materials. It has also been found that in the interval during which the piston-operated openings or nozzles are open the flow of air out of the manifold chamber causes the pressure in the manifold chamber to drop quickly so that the bursts of air have to be of quite short duration.

Co-pending application Ser. No. 349,780 filed May 1, 1989, titled "CONTINUOUS FLOW AIR BLENDER FOR DRY GRANULAR MATERIALS" by the same inventor as the instant applicant describes a similar blender or mixer in which short bursts of pressurized air are repeatedly applied upward into the granular materials while they are being fed into the top of the hopper with the bottom discharge outlet being held open so that the materials are being mixed together as they continuously flow through the blender. The piston-operated openings or nozzles in the manifold of the '780 application are oriented to direct the air upward and inward at about five degrees towards the longitudinal axis of the hopper to cause swirling and turbulence to mix the materials together as they flow into and through the hopper. The material fed into the hopper tends to flow in a central column downward directly toward the discharge outlet so the nozzles are placed at an angle to direct the air inward toward the center so that the bursts of air force the material back upward and toward the walls of the hopper in a swirling fashion to accomplish suitable mixing.

SUMMARY OF THE INVENTION

The instant invention utilizes a bin or hopper and a pressurized air manifold containing piston-operated openings or nozzles similar to the '891 patent and the '780 copending application. Similar to the '891 patent, the instant invention is for use in or as a noncontinuous flow blender, i.e., one in which the materials are first inserted into the hopper as a batch and then blended together before being discharged. In the instant invention the manifold openings or nozzles are oriented so that the bursts of pressurized air which are applied upward into the interior of the filled hopper may range from being parallel to the longitudinal axis of the hopper or inward toward the longitudinal axis up to about five degrees. Used in this fashion in a noncontinuous flow blender, the repeated bursts of pressurized air repeatedly lift and drop the batch of material contained in the hopper to cause the materials to tumble about until they are blended together. This is especially beneficial where the materials are fairly large-grained and/or where the hopper contains a heavy or high stack of materials.

Because a wide range of materials and batch sizes are mixed in this fashion, it is necessary to be able to control to some degree the pressure at the manifold when the nozzles are opened since the duration and frequency of the air pulses may have to be significantly varied from one load to another and adequate pressure must be sustained long enough to insure that the batch is raised and dropped to create the tumbling action. An adjustable throttle valve is provided in the air flow path from the air pressure source to the manifold in order to control the flow of air from the pressure source to the manifold and thereby provide some degree of control of the pressure at the manifold when the nozzles are opened to inject air into the hopper for mixing.

DESCRIPTION OF THE PREFERRED EMBODIMENTS

Figure 1:
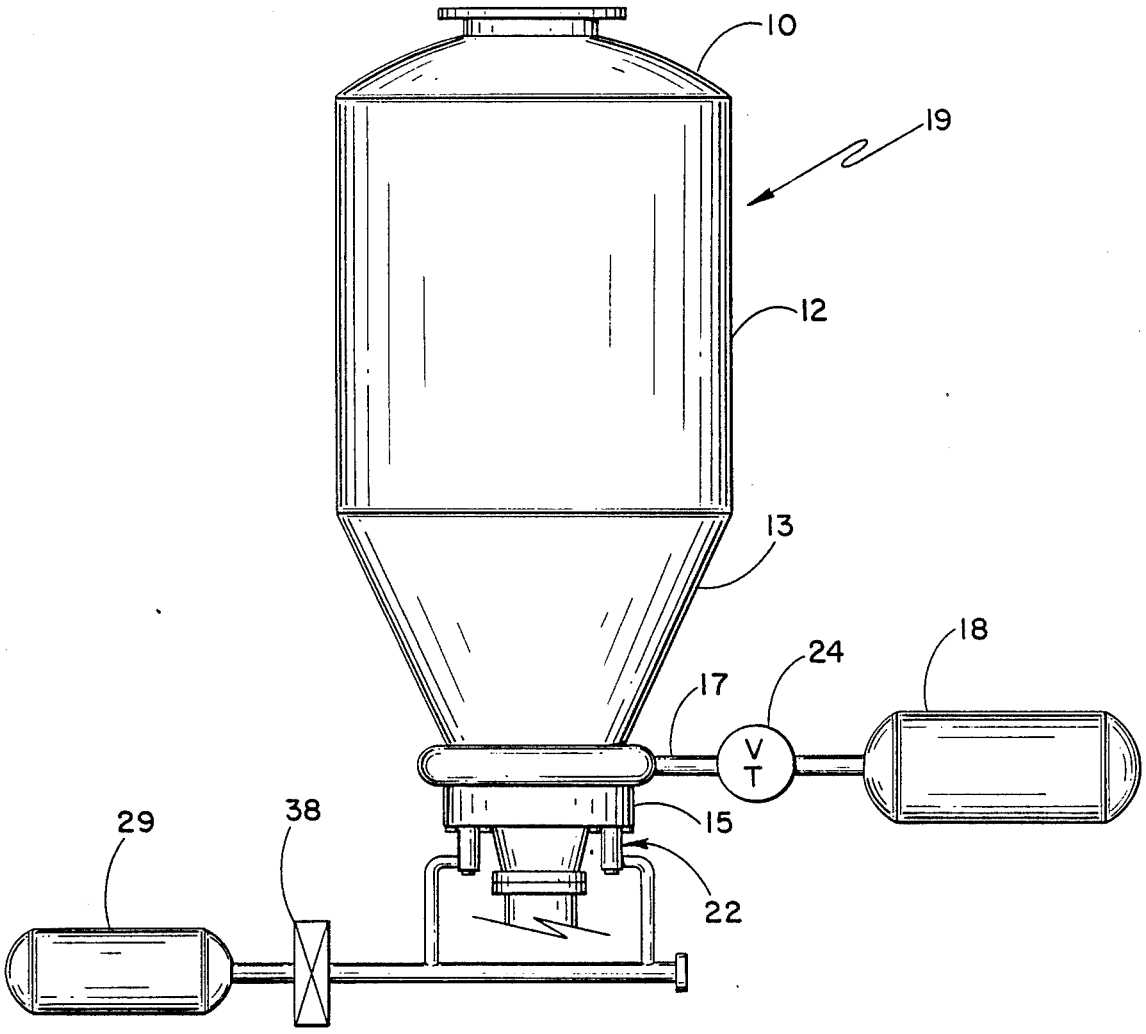
FIG. 1 is a general elevational view of an air blender incorporating the teachings of this invention.

A conventional generally cylindrical vessel, bin or hopper 19 (hereinafter hopper) used for pneumatically blending together various granular materials is closed off at the top 10 except for an inlet opening 11 through which dry granular materials may be injected into the hopper when butterfly valve 21 is opened, has vertically disposed sidewalls 12 which attach to lower inwardly sloping sidewalls 13. Sidewalls 13 slope toward a centrally located bottom discharge opening 14 which is surrounded by an annular pressurized air manifold 15. A cone-shaped member 35 closes off discharge outlet 14 while the materials are being fed into the hopper and while they are being blended. By means not shown closure 35 can be raised to allow the batch of materials contained in hopper 19 to flow out through discharge outlet 14. Conventionally, manifold 15 has an interior chamber 16 containing pressurized air provided by conduit or hosing or pipeline 17 from a suitable air pressure source represented by tank 18. An adjustable throttle valve 24 is located in pipeline 17 the purpose and function of which will be described later. Manifold 15 has a number of circumferentially spaced openings or nozzles 20, preferably equally spaced apart, around the discharge opening 14 for providing air communication between chamber 16 and the interior of hopper 19 to direct the pressurized air in chamber 16 upward into the interior of the hopper when the nozzles are opened. Nozzles 20 are arranged so that the air flow path through them parallels the vertical center line of hopper 19 or they may be angled slightly inward toward the vertical axis of hopper 19 up to about five degrees.

Mounted within manifold 15 opposite each of the openings or nozzles 20 is an air operated poppet valve assembly generally designated by reference numeral 22. Poppet valve assembly 22 comprises a cylinder housing 23 containing a slidably mounted piston which has a stem 25 which extends out beyond the end of housing 23 and has a seal 26 at its stem end facing opening or nozzle 20. An air inlet, not shown, through housing 23 permits pressurized air from a suitable air supply 29 to enter into each poppet valve cylinder chamber via a suitable pipeline, hose or conduit 30. Cylinder housing 23 and its piston are suitably sealed to make the interior of cylinder housing 23 air-tight. Means, not shown, are provided which may be used to adjust the setting of the poppet valve assembly to control the degree of opening when the valve is operated to open nozzles 20.

Figure 2:
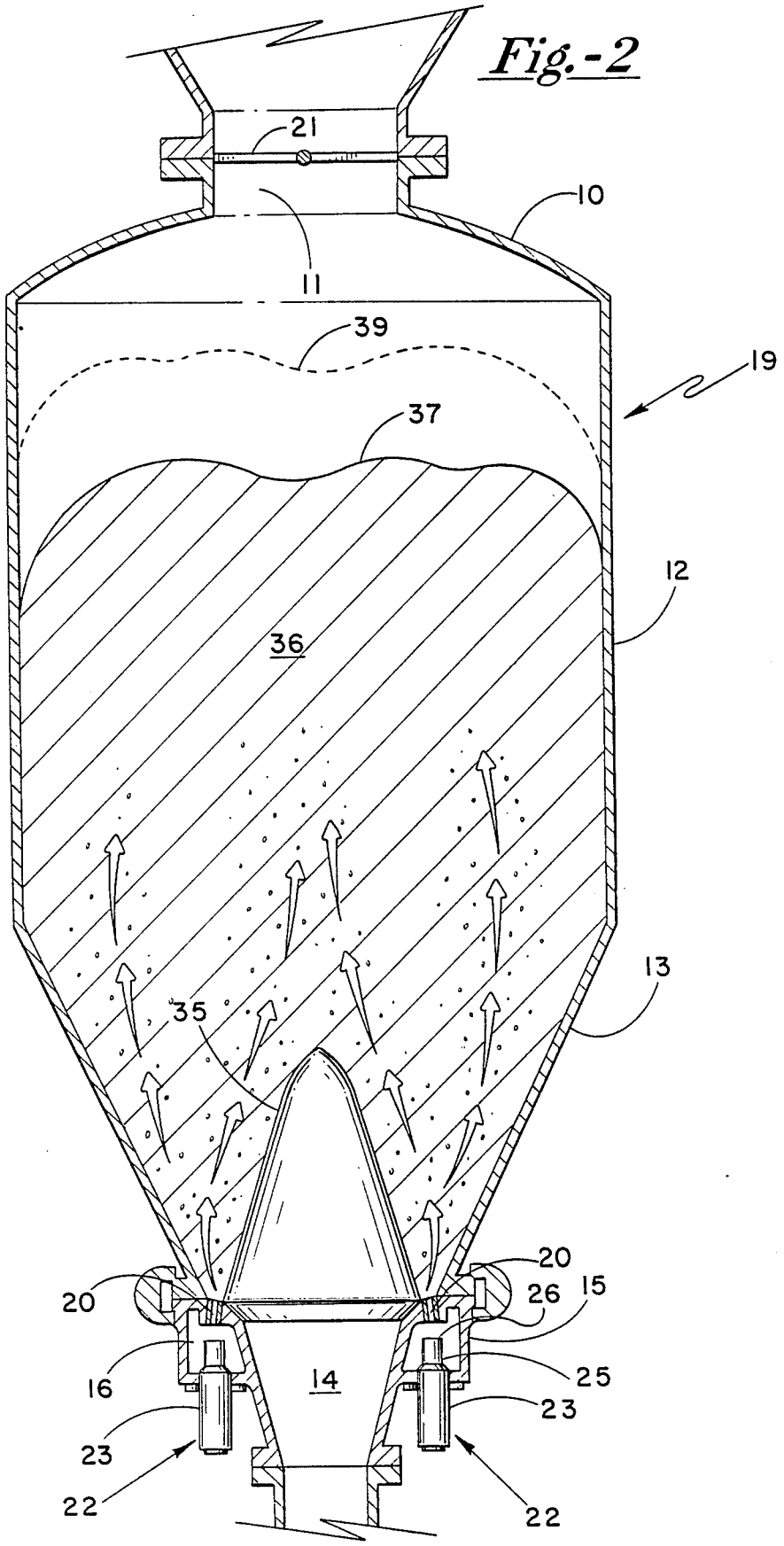
FIG. 2 is a sectioned diagrammatical illustration of the operation of the invention.

Dry granular materials, identified by crosshatch lines 36, which are generally pneumatically transported via a suitable conduit or pipe (not shown) are fed into the inlet opening 11 at the top of hopper 19 by swinging open butterfly valve 21. Two or more materials are fed into the hopper for the purpose of mixing these materials together into a homogeneous mixture. As illustrated in FIG. 2, the batch of materials piles up in the hopper to a level as designated by solid line 37 with closure member 35 in the lowered position closing off outlet 14. A solenoid-controlled valve 38 is operated to permit air from air supply 29 to enter into the cylinder chambers of poppet valves 22 so that each valve piston is driven to its furthest upward position to seal off its associated opening or nozzle into the interior of hopper 19. At the same time air is being supplied from the source 18 into chamber 16 of manifold 15 but at a pressure somewhat lower than that being applied to the piston of poppet valve 22. This holds the valve piston so that it closes the nozzle 20 and no pressurized air is allowed into the interior of the hopper 19. For mixing or blending together the batch of material contained in hopper 19, solenoid valve 38 is operated so that the air pressure applied into the cylinder of poppet valve 22 is reduced below that of the air pressure in chamber 16 so that the piston member is driven away from nozzle 20 and a blast of pressurized air is injected upward into the interior of the hopper 19 through nozzles 20. The duration of the air blast is a matter of choice and is dependent upon a number of different factors such as the amount and types of materials in the batch, the degree of mixture that is desired, air pressures, etc. Because of the orientation of the nozzles 20, the blast of air applied causes the batch of material in the hopper to raise or lift upward such as to position shown by dashed line 39 and when the nozzle is closed off to remove the pressurized air the batch drops back down. Repeated lifting and dropping of the material in this fashion creates a tumbling action which eventually results in the materials in the batch being moved and intermixed until they are blended into a homogeneous mass.

The duration of each burst of pressurized air into the hopper, the burst cycle, i.e., time on and time off, and the number of cycles which must be applied to a given batch of material for optimum blending may have to be initially determined empirically by testing a small batch of materials and may have to be adjusted for a given batch or from batch to batch.

The air blender described in the '891 patent utilizes a swirling action for mixing together the ingredients contained in the hopper. In that case when the manifold nozzles are opened the air pressure drops quickly. For example, in a typical case utilizing the '891 blender the air pressure in the manifold chamber may be set at about 20 psi and quickly drops to 1 or 2 psi when the nozzles are opened for a burst duration of about one and one-half seconds because of the flow of air from the air source into the manifold chamber and out the nozzles. In the present case where heavier and larger batches of material are to be mixed by the tumbling action as described hereinabove, it is necessary to be able to reduce or at least control the air flow to some degree so that the air pressure at the nozzles does not drop quickly to a very low level when the nozzles are opened. To accomplish this, adjustable throttle valve 24 is placed in air line 17 from air pressure source 18 to manifold 15. For each batch of material to be mixed the setting of throttle valve 24 can be adjusted to control the air flow and thereby control, to some degree, the rate at which the air pressure at the nozzles drops when the nozzles are opened to insure that sufficient air pressure is maintained when the nozzles are opened to keep the batch of materials raised sufficiently so that when the nozzles are repeatedly opened and closed the tumbling action can occur in the fashion as described earlier. Typically, for example, to produce the tumbling action in the instant blender the air pressure initially in the manifold may be in the order of about one-hundred psi and by controlling the air flow by adjustment of throttle valve 24 it may drop to about forty or fifty psi's during a one to two second duration burst so that when the nozzle is repeatedly closed and opened the batch of materials wlll raise and drop in a fashion to create the tumbling action for mixing the materials together.

I claim:

1. In an air blender for pneumatically mixing together dry granular materials comprising a vertically oriented elongated container having an input opening at the top for inputting granular materials to be mixed, cylindrical side walls, a normally closed central discharge opening at the bottom, lower walls sloped inwardly from the bottom of the cylindrical walls to said discharge opening, and an air manifold surrounding said discharge opening having an inner air chamber containing pressurized air, the improvement comprising:

a series of air nozzles in the manifold equally spaced around the discharge opening for providing air communication between the inner air chamber of the manifold and the interior of the container, said nozzles oriented at an angle to direct the pressurized air generally parallel to the longitudinal axis of the container;

means for repeatedly opening and closing said nozzles;

a source of pressurized air;

conduit means for delivering pressurized air from said source of pressurized air to the inner chamber of the manifold; and adjustable throttling valve means located in said conduit for controlling the air flow into the manifold inner chamber from said pressurized air source when said nozzles are opened.

2. The invention as described in claim 1 wherein said nozzles are oriented at an angle to direct the pressurized air ranging from parallel to the longitudinal axis of the container to about five degrees inward toward the longitudinal axis.

3. The invention as described in claim 2 wherein the pressurized air in said manifold chamber is in the range of about 100 pounds per square inch when the nozzles are closed.

4. The invention as described in claim 2 wherein the nozzles are oriented at an angle to cause the materials in the hopper to tumble about and mix together in a substantially homogeneous mass when the nozzles are repeatedly opened and closed.

* * * * *